US005692562A

United States Patent [19]

Squires

[11] Patent Number: 5,692,562

[45] Date of Patent: Dec. 2, 1997

[54] WELL ROD, CENTRALIZER AND CENTRALIZER STOP INTERFACES WITH WEAR REDUCING SURFACE

[75] Inventor: Andrew Squires, Calgary, Canada

[73] Assignee: Enterra Patco Oilfield Products Limited, Calgary, Canada

[21] Appl. No.: 528,334

[22] Filed: Sep. 14, 1995

Related U.S. Application Data

[63] Continuation-in-part of Ser. No. 421,243, Apr. 13, 1995.

[51] Int. Cl.[6] ..... E21B 17/10

[52] U.S. Cl. ..... 166/68.5; 166/241.3

[58] Field of Search ..... 166/241.3, 241.4, 166/241.2, 241.1, 68.5; 175/325.3

[56] References Cited

U.S. PATENT DOCUMENTS

| | | | |
|---|---|---|---|
| 3,104,134 | 9/1963 | Nielsen et al. | 175/325.3 |
| 4,182,537 | 1/1980 | Oster | 166/241.3 |
| 4,606,417 | 8/1986 | Webb et al. | 175/325.3 |
| 4,757,861 | 7/1988 | Klyne | 166/241.3 |
| 5,191,938 | 3/1993 | Sable et al. | 166/241.3 |
| 5,247,990 | 9/1993 | Sudol et al. | 166/241.3 |
| 5,339,896 | 8/1994 | Hart et al. | 166/241.1 |

*Primary Examiner*—Hoang C. Dang
*Attorney, Agent, or Firm*—Browning Bushman

[57] ABSTRACT

Improved wear interface surfaces on well rod centralizers and centralizer stops. Well apparatus includes a rotary tool in a string of tubing extending into a well hole in the earth and a rod extending to the ground surface through such tubing which is drivingly connected to the tool. Centralizers are used on the rod and are located between a pair of centralizer stops. The stops and centralizers associated therewith having wear interface surfaces and at least one of the wear interface surfaces which abut one another having a material thereon of a hardness in the range of 7 to 10 in Mohs scale of hardness and thereby having a hardness greater than the hardness of abrasive materials likely, during use, to pass through said tubing.

19 Claims, 5 Drawing Sheets

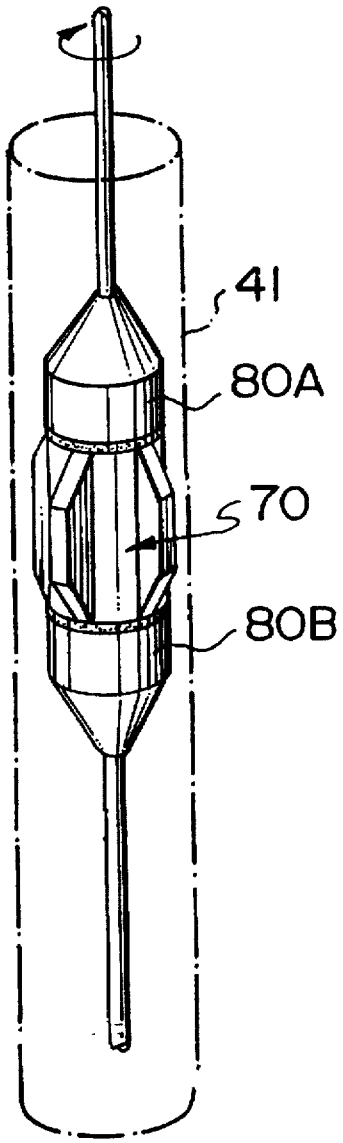
FIG. 2
FIG. 2a
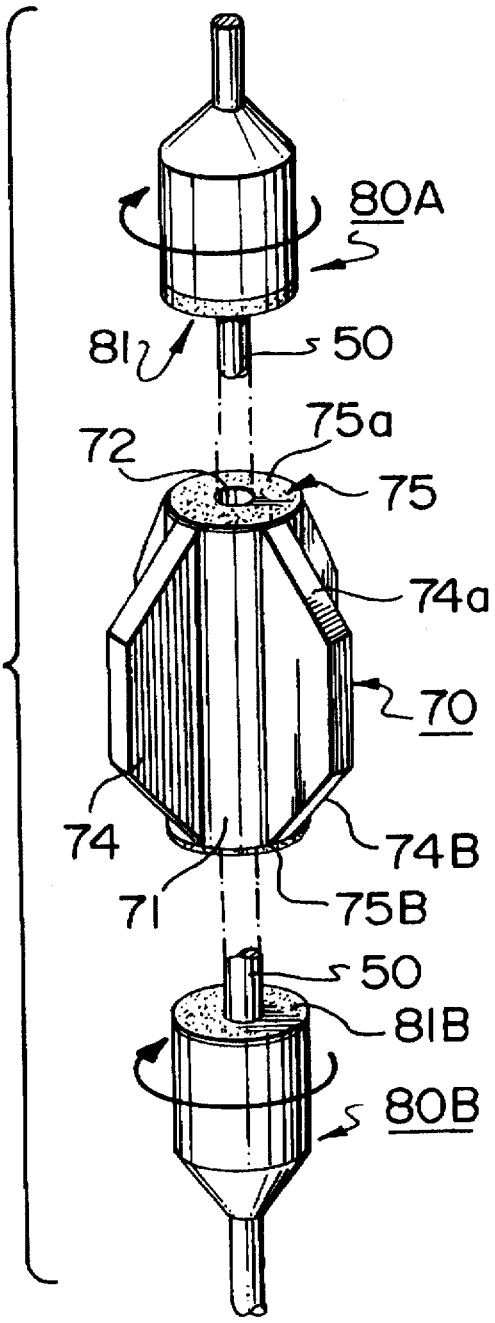

WELL ROD, CENTRALIZER AND CENTRALIZER STOP INTERFACES WITH WEAR REDUCING SURFACE

RELATED APPLICATION

This application is a Continuation-In-Part of U.S. application Ser. No. 08/421,243 filed Apr. 13, 1995.

FIELD OF INVENTION

Disclosed in the above mentioned U.S. application Ser. No. 08/421,243 are improvements to rod centralizers and/or centralizer stops used in applications where the rod is rotated to drive a pump or equipment downhole and more particularly to providing a hardface surface on one or more of the interfaces to reduce wear. The interface surfaces, where wear occurs, are the end face of the centralizer and an end face of an adjacent centralizer stop and also the wall surface of the hole through the centralizer and the rod. This application contains additional matter related to reducing wear to the rod and/or the hole through the centralizer for the rod.

BACKGROUND OF INVENTION

Apparatus is well known for pumping liquids, for example oil, from a well to the surface through a string of tubing. The apparatus includes a rod (or string of rods connected one to the other in end-to-end relation and herein referred to as a rod) and tubing for the rod with the rod being located within the tubing. The bottom end i.e. the lowermost end of the rod is connected to the rotor or driveshaft input of any suitable downhole pump. The rotation of the rod drives the pump causing the upward flow of liquid through the tubing.

The rod has centralizers thereon at suitable spacings along the rod and each centralizer is limited in movement in a direction axially along the rod by being disposed between a pair of centralizer stops.

The centralizers of concern herein fit loosely on the rod and the rod itself rotates in a bore hole through the centralizer. The centralizer is free to rotate on the rod and may do so on the bare rod body or on some form of race or sleeve assembly which is molded or placed over the rod. To position the centralizer linearly along the length of the rod it is customary to have centralizer end stops fixed to the rod. These end stops are constructed of metal, plastic, or the like materials and are molded or placed on the rod. The purpose of the end stops is to position each centralizer in a particular linear position along the rod length thus preventing the centralizer from moving linearly beyond its predetermined permitted movement along the rod.

Contact occurs between adjacently disposed opposing end faces of the centralizer and the centralizer stop. This wear interface of the centralizer and the centralizer stop is subject to abrasive wear as the centralizer stop, which is attached to the rod, is in rotational movement while the centralizer itself normally remains stationary. Wear also occurs at the interface between the centralizer and the rod or sleeve on the rod. Wear of the wall surface defining the hole through the centralizer enlarges the hole which is not desirable. The wear problem is aggravated when operating in environments in which the production fluid contains abrasives such as sand particles or like. In such instance wear at the interfaces between the centralizer and the centralizer stops and between the centralizer and the rod (or mounting sleeve on the rod) can be very rapid.

SUMMARY OF THE INVENTION

In accordance with the present invention wear at an interface between a centralizer and a centralizer stop is reduced by making one or both engagement surfaces out of materials that are as hard as or harder than the abrasive that causes the wear. This is done by lining, coating or applying a layer or attaching an insert such as a sleeve, a wafer, or a combination thereof to one or both of the contact surfaces which contains a material that is as hard as or harder than the abrasives encountered. The term "hardfacing" is used herein to describe a wear interface which has been provided with particles that are harder than the remainder of the centralizer (or centralizer stop as the case may be). In most instances particles of sand cause the damage and in such instance a material such as ceramic or diamond is utilized to provide the hardfacing. By hardfacing both of the interface surfaces in question, wear is reduced as any abrasives that enter the interface region would be crushed and ground to a powder. Only one of the interface surfaces may be hardfaced and during use the other surface will become hardfaced. During use some of the abrasive particles will become embedded in the other opposing surface and after time in use the initial hardfaced surface will polish or smooth the abrasive particles in that other surface resulting in a low friction hard wear surface itself.

LIST OF DRAWINGS

The invention is illustrated by way of example in the accompanying drawings wherein:

FIG. 2 illustrates a portion of the well tubing, string rod and centralizer and centralizer stops shown in FIG. 1;

FIG. 2A is an exploded enlarged view of a portion of the rod, centralizer and centralizer stops of FIG. 2;

DESCRIPTION OF PREFERRED EMBODIMENT

Figure 1:
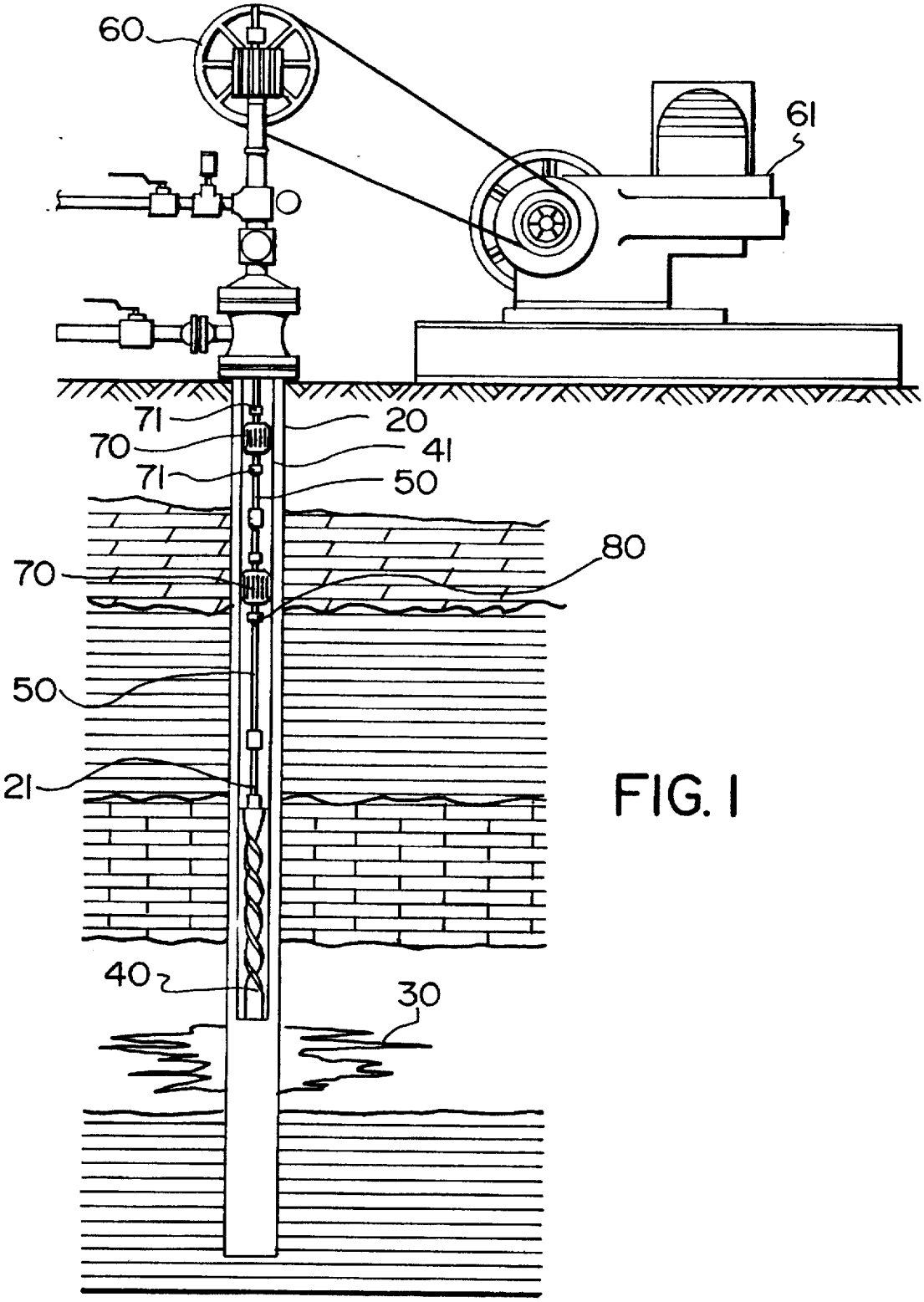
FIG. 1 is a diagrammatic, partial sectional elevational view of a well pumping system incorporating the present invention.

Illustrated in FIG. 1 is a well casing 20 extending downwardly into the ground into a production fluid 30. This production fluid is pumped above ground by a pump unit 40 located in a string of tubing 41 within the casing 20. The pump is operated by a rod 50 driven to rotate about its longitudinal axis (herein vertically disposed) by a driver 60 driven by a motor 61.

On the rod 50 there are a plurality of rod centralizers 70, each located between a pair of spaced apart centralizer stops 80 fixedly secured to the rod 50. The stops are made of for example a 33% glass fiber reinforced polyphthalamide (PPA) or (filled or unfilled) polyphenylene sulfide (PPS) containing any one of a number of different fillers or Nylon™ or Nylon™ filled fibre (NFF).

FIG. 2A shows, in exploded and broken perspective, one of the centralizers 70 and a portion of the rod 50 with stops 80 in which the top stop is designated 80A and the bottom stop designated 80B. Top and bottom in this description are respectively stops above and below a centralizer disposed between such pair of stops.

The centralizer 70 has a cylindrical body 71 with a through bore or central hole 72 slightly larger in diameter than the rod 50 whereby the rod 50 is readily rotatable relative to the centralizer. The cylindrical body 71 has a plurality of ribs 74 projecting outwardly therefrom. The ribs 74 are spaced apart from one another circumferentially around the body and are parallel to the longitudinal axis of the rod 50. The ribs 74 have respective opposite tapered ends 74A and 74B. During pumping fluid flows through the channels located between the ribs. The centralizer may in some instances have a longitudinal slot extending from one end to the other and at an angle to the longitudinal axis of the rod for ease of placement of the centralizer on the rod in the field.

In the embodiment illustrated in FIGS. 2 and 2A the centralizer 70 has a top end 75 with a hardened surface 75A that comes into abutment with the bottom end 81 of the stop 80A. Such bottom end of stop 80A and the top end 75 of the centralizer are each coated or otherwise provided for example by an insert with a material that is harder than the material of the centralizer/centralizer stop associated therewith. The material for example may be bort (diamond), ceramic oxide or cemented carbides. Common abrasive materials are aluminum oxide, silicone carbide and diamond grit and for grinding flint, garnet, emery and corundum are commonly used. A suitable material may be selected to provide the desired characteristics.

Abrasives normally encountered in the production fluid are sand particles. These particles are mainly quartz and in Mohs scale of hardness they have a hardness 7 or approaching 7. Materials which are harder are topaz (8), sapphire (9), and diamond (10). The selection of materials will depend upon conditions expected to be encountered and while in the broadest aspect the material provides a surface harder than that of the centralizer, or centralizer stop as the case may be, such surface has exposed particles that preferably have a hardness in the range of 7 to 10.

The bottom stop 80B has an upper face 81B that engages the bottom surface 75B of the centralizer. The surfaces 81B and 75B also have surfaces of wear resistant material such as ceramic or diamond. The surface or particles exposed thereon are sufficiently hard as to grind quartz and other particulate material that may be transported in the production fluid as it is pumped to the surface.

Figure 3:
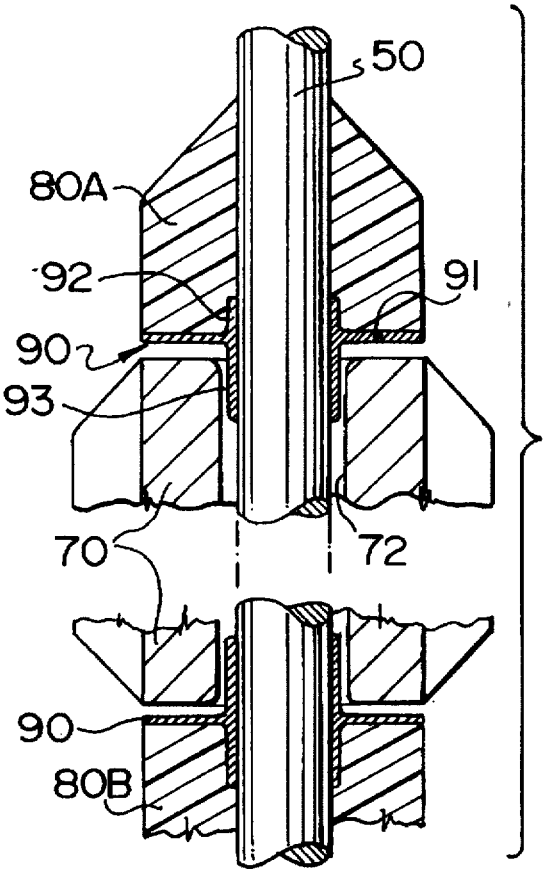
FIG. 3 is a part sectional view illustrating another embodiment.
Figure 4:
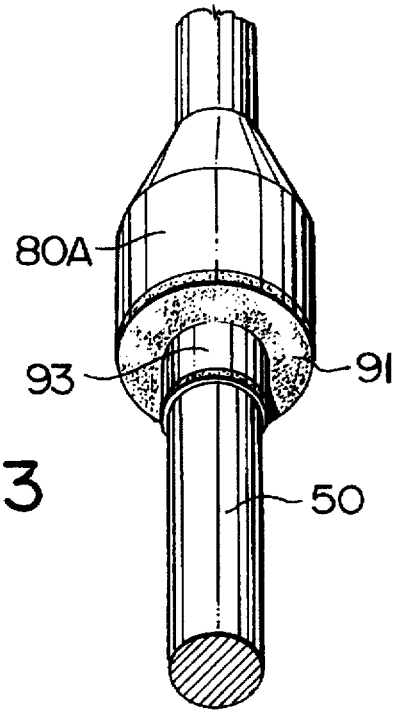
FIG. 4 is an oblique view of one of the rod centralizer stops of FIG. 3.

As previously mentioned the hardfacing may be variously provided as for example by a coating applied, by a layer of suitable material attached or by a separate insert such as a wafer or sleeve. FIGS. 2 and 2A represents an embodiment wherein the material is in the form of a layer adhesively bonded to the stop, or centralizer as the case may be. FIGS. 3 and 4 illustrate an embodiment in which a ceramic insert 90 is attached (adhesively or by other suitable means) to the lower face of an upper or top centralizer stop 80A and a similar ceramic insert 90 is attached to the upper face of a lower stop 80B. These inserts (fixed relative to the rod) have a flange and these engage or abut respectively the upper and lower end surfaces of the centralizer body. In this embodiment particulate material that becomes embedded in the end faces of the centralizer body is ground to a smooth surface by the ceramic insert (or other abrasive material on the inserts such as diamond grit) leaving embedded particles of quartz in the centralizer body that are ground to a flat finish and thereby become a hardened surface during use.

Each insert 90 has an annular plate portion 91 on the face of the stop member, a sleeve 92 that projects into the stop providing a secure anchor thereto and a sleeve portion 93 that projects into the bore 72 through the centralizer. The stops 80A and 80B are fixed to the rod 50 and the latter rotates in the through bore 72 in the centralizer. In this embodiment the outer surface of sleeve 93 is hardfaced and this provides bearing surfaces for relative movement between the rod and centralizer. Again as before mentioned the other hardfacing (i.e. internally of bore 52) is formed during use from particles that become embedded.

Figure 5:
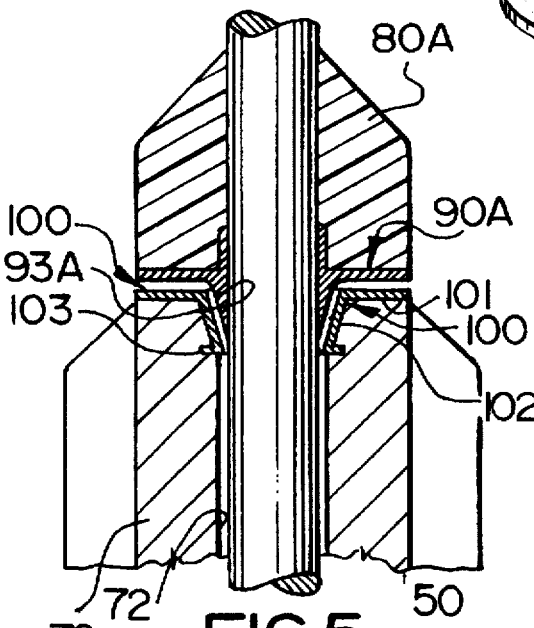
FIG. 5 is a partial sectional view of a portion of a rod centralizer and adjacent stop of another embodiment.

FIG. 5 illustrates an alternative embodiment first with respect to the shape of the insert from that shown in FIG. 3 and secondly in that there is an insert on each of the pair of centralizer stops and at each of opposite ends of the centralizer body.

Referring to FIG. 5 there is an insert 90A similar to insert 90 of FIG. 3 but where the sleeve projecting into the bore through the centralizer is tapered as indicated by reference 93A. There is an insert 90A on each of the respective upper and lower stops. A pair of inserts (ceramic or the like) 100 are secured respectively to opposite ends of the centralizer 70 and each has a first flat annular portion 101, a truncated conical sleeve portion 102 and an outwardly directed end flange portion 103. The flange 103 securely anchors the insert to the rod centralizer. The lower stop and adjacent end face of the centralizer each have a similar insert secured thereto. In this embodiment there is an insert at each of opposite ends of the centralizer which may be referred to as a first pair of inserts and there is an insert on each of the pair of centralizer stops which may be referred to as a second pair of inserts.

Figure 6:
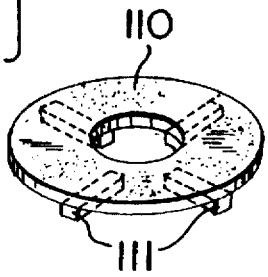
FIG. 6 is an oblique view of a wafer of hard material on one face and lugs on the other face for gripping an end face of a rod centralizer or centralizer stop as the case may be.
Figure 6B:
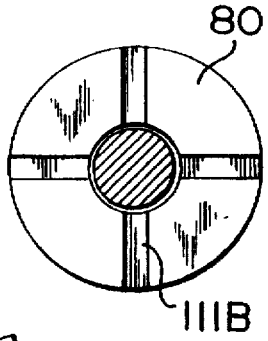
FIG. 6B is a top plan view of a centralizer stop with grooves to receive lugs of a wafer shown in FIG. 6.
Figure 6A:
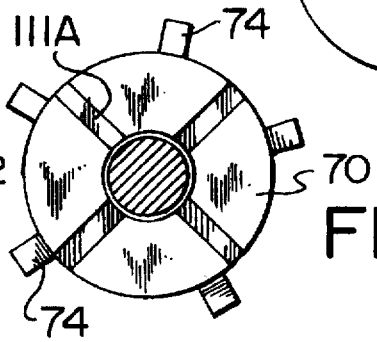
FIG. 6A is a top plan view of a centralizer with grooves to receive the wafer lugs.

Another embodiment is shown in FIG. 6 wherein the hardfacing is provided in the form of a wafer 110 which may be fastened for example by a high temperature epoxy adhesive to the stop, or centralizer as the case may be. The wafer, of for example ceramic or other suitable material, may have suitable positioning and/or anchor means such as pins, slots, ridges or combinations thereof to maintain alignment during drying/curing and for added adhesion/stability during use. Referring to FIG. 6 the wafer 110 is shown with lugs 111 projecting from the bottom face and these mate with corresponding grooves 111A in an end face of a centralizer 70 (FIG. 6A) or grooves 111B in a centralizer stop 80 (FIG. 6B) as the case may be.

In the foregoing embodiment illustrated in FIGS. 3 and 5 the sleeve inserts 90, 90A and 100 provide journals for the centralizer 70 and these journals maintain a space between the inner surface of the bore 72 and the rod 50. These inserts provide wear faces for axial as well as radial load forces. Embodiments illustrated in FIGS. 7 to 12 are variations and modifications to the embodiments of FIGS. 3 and 5 and address the issue of wear at the interface between end faces of the centralizer stops and the centralizer as well as wear that occurs to the rod and/or inner wall surface that defines the hole 72 through the centralizer.

Figure 7:
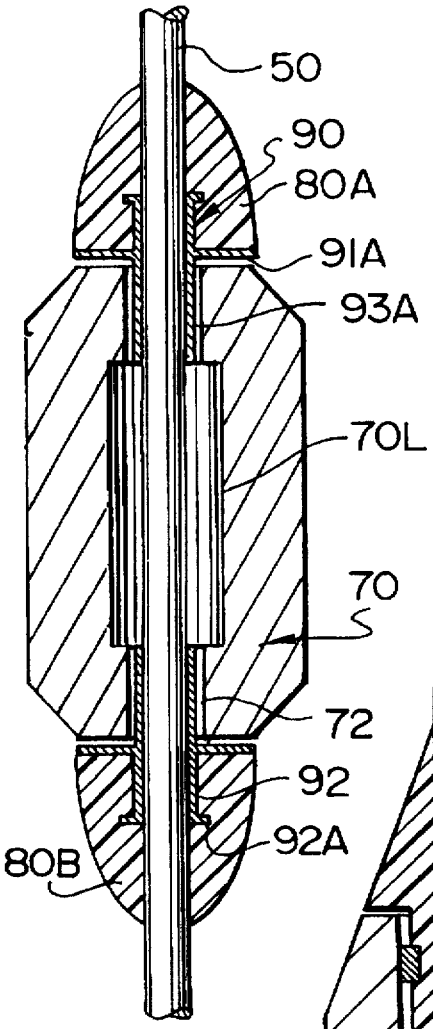
FIG. 7 is a partial sectional view, similar to FIG. 3, illustrating a modification to the internal bore of the centralizer.

Referring to FIG. 7 plastic end caps 80A and 80B are molded on the rod 50 and thus are secured thereto and they are molded onto the sleeve portion 92 of an insert 90. As seen in the drawing there is an insert 90 for each end stop. The sleeve 93 for each insert 90 projects into an end portion of the centralizer 70 and provides a bearing. Beyond this bearing surface the centralizer 70 has an enlarged central bore portion designated 70L. A spacing from the rod 50 minimizes wear on the rod during relative movement of the rod and centralizer. As is the case with the embodiment illustrated in FIG. 3 the flange 91 of the insert has a hard face, herein designated 91A which is disposed in face to face relation with an adjacent end face of the centralizer. The sleeve 93 has a hard faced outer surface designated 93A which is also the case in the embodiment illustrated in FIG. 3.

Figure 8:
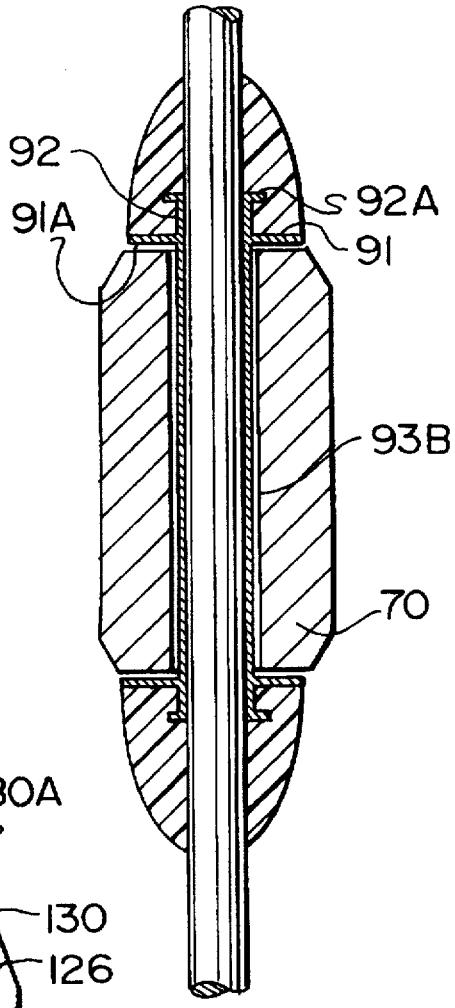
FIG. 8 illustrates a continuous sleeve that extends through the centralizer and flanges that provide end faces for the centralizer stops.

FIG. 8 illustrates an embodiment in which the previously described sleeves 93 in FIG. 3 are replaced by a sleeve designated 93B which extends from one insert flange 91 to the other located respectively at opposite ends of the centralizer 70. In each of the embodiments illustrated in FIGS. 7 and 8 an outwardly directed flange 92A is located at the end of flange 92 for securement of the end stop to the insert.

Figure 9:
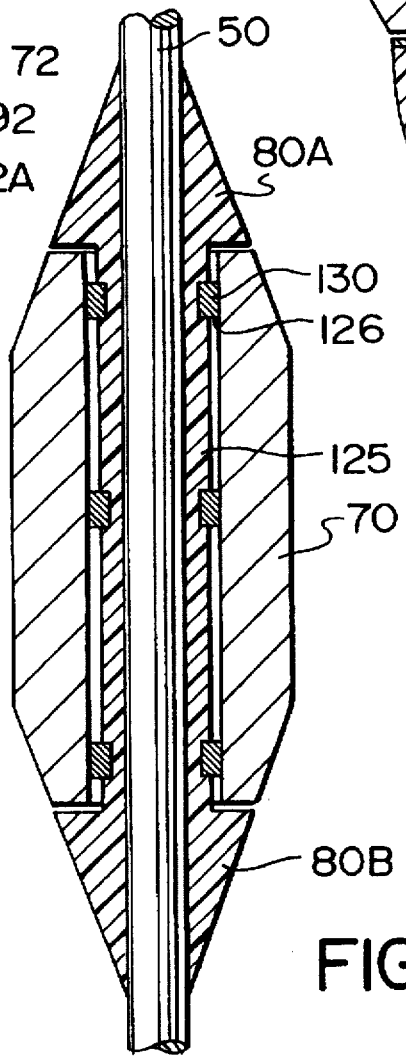
FIG. 9 is a partial sectional view through plastic end stops and sleeve secured to the rod and a centralizer journalled on hardcoated snap rings on the sleeve.

Referring to FIG. 9 there is illustrate the rod 50 with a centralizer 70 and a pair of end stops 80A and 80B located respectively at opposite ends of the centralizer. In this embodiment the end stops 80A and 80B (made of a plastics material) are interconnected by a plastic sleeve 125. On the outer surface of this sleeve there are grooves 126 that receive respective ones of a plurality of C-shaped snap rings 130. Each snap ring 130 is hardcoated on the outer surface so as to minimize wear.

Figure 10:
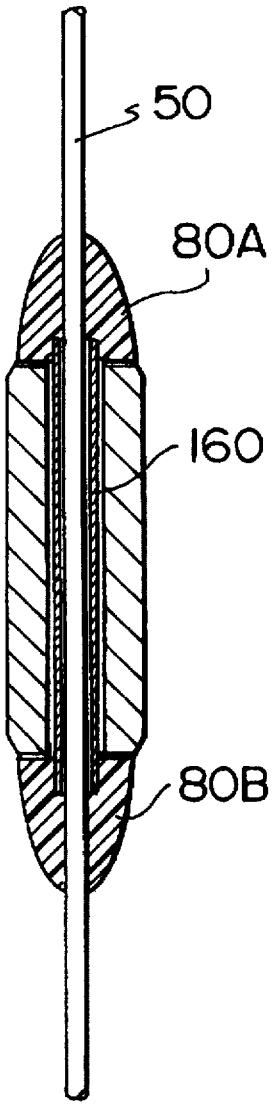
FIG. 10 illustrates an embodiment wherein the centralizer rotates on a hardcoated sleeve secured on the rod and with opposite ends projecting into respective ones of the end stops.
Figure 11:
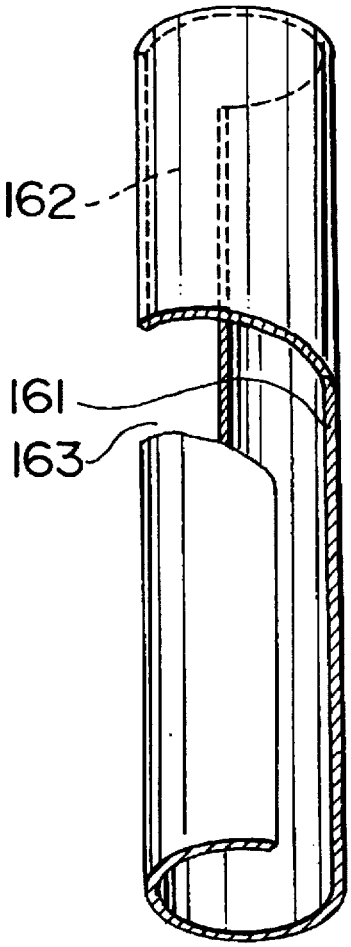
FIG. 11 is an oblique view of one embodiment of a sleeve for use in the embodiment illustrated in FIG. 10.
Figure 12:
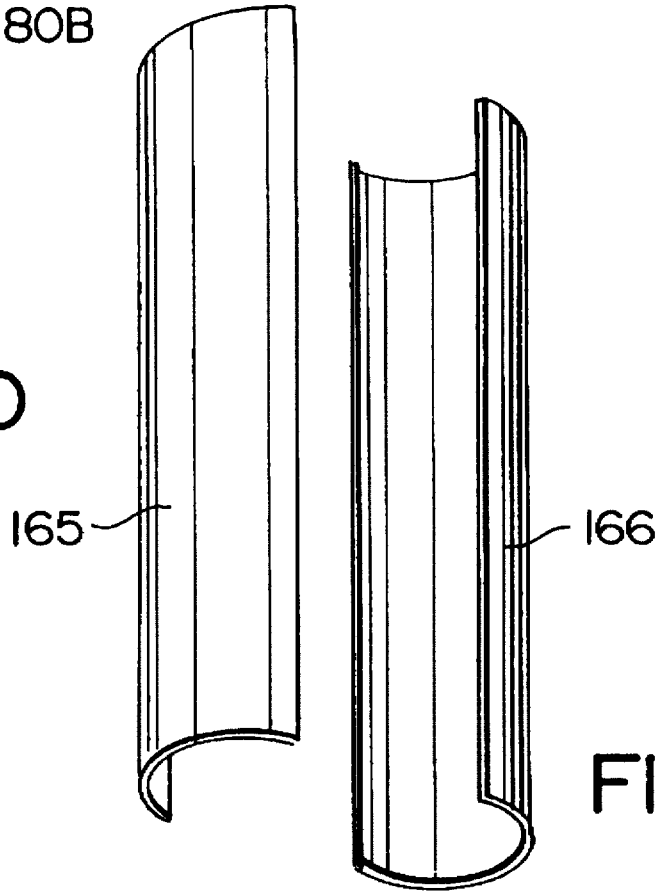
FIG. 12 is an oblique view of a two piece split sleeve for the embodiment of FIG. 10.

In FIG. 10 there is illustrated a rod 50 with a sleeve 160 held thereon by spaced apart end stops 80A and 80B. The sleeve may be held on the rod also by a suitable adhesive such as, for example an epoxy adhesive. One embodiment of the sleeve 160 is illustrated in FIG. 11 in which there is respective longitudinal gaps or slots 161 and 162 offset from one another approximately 180° and they joined by a further slot or gap 163 that extends circumferentially around the sleeve from one slot 162 to the other slot 161. The sleeve 160 shown in FIG. 10 alternatively may be a two-piece sleeve illustrated in FIG. 12. This two piece sleeve in FIG. 12 has respective portions 165 and 166.

In the embodiment illustrated in FIG. 8 the surfaces 91A of the insert for the end stops are hard coated as is also the outer surface of the sleeve. In the embodiments illustrated in FIGS. 10, 11 and 12 the outer surface of the sleeve is hard coated with a suitable material. In the embodiment illustrated in FIG. 9 this hard coating is limited to the snap rings 130. The mating surfaces on the centralizer 70 become hard coated during use through particles of sand becoming embedded and ground to a smooth finish by the other abutting surface which is initially provided with a hardfacing.

The foregoing discloses end stops and rod centralizers which are made of a material softer than one or both surfaces of wear interfaces of such stops and centralizers. Also inserts may be used to provide such interfaces as well as provide journals for relative movement between the rod and the rod centralizer.

I claim:

1. Well pumping apparatus for powering a downhole pump to pump fluids toward the surface of a well through a string of well tubing, comprising:

an elongate rod string within the well tubing and interconnected with the downhole pump, the rod string being rotatable within the well tubing to power the downhole pump; and a rod centralizer for centralizing the rotating rod string within the well tubing, the rod centralizer including a plastic material body having a hole therethrough for receiving the rod string, a plurality of ribs projecting radially from the plastic material body and spaced apart circumferentially to provide a plurality of flow channels for fluids passing through the well tubing in response to the downhole pump an past the rod centralizer, and upper stop and a lower stop each fixed on me rod string to limit axial movement of the plastic material body along the rod string and between the upper stop and the lower stop, a wear interface stop surface on at least one of the upper stop and the lower stop for planar engagement with an end surface of the plastic material body, an upper sleeve fixed at an upper end to the upper stop and extending axially through an upper portion of the hole in the plastic material body for engagement with an upper interior surface of the plastic material body defining an upper portion of the hole, an opposing lower end of the upper sleeve terminating within the hole in the plastic material body above the lower stop, and a lower sleeve fixed at a lower end to the lower stop and extending axially through a lower portion of the hole in the plastic material body for engagement with a lower interior surface of the plastic material body defining a lower portion of the hole, an opposing upper end of the lower sleeve terminating within the hole in the plastic material body below the upper stop.

2. The well pumping apparatus as defined in claim 1, wherein the plastic material body has an enlarged bore spaced axially between the upper sleeve and the lower sleeve and defining an enlarged portion of the hole, the enlarged bore having a diameter greater than both the upper interior surface and lower interior surface of the plastic material body for preventing the plastic material body from engaging the rod string upon wear of the plastic material body due to engagement with the upper sleeve and the lower sleeve.

3. The well pumping apparatus as defined in claim 2, wherein the enlarged bore in the plastic material body is spaced axially substantially midway along the plastic material body and between the upper sleeve and the lower sleeve.

4. The well pumping apparatus as defined in claim 1, the rod centralizer further comprising:

another wear interface stop surface on the other of the upper stop and the lower stop for planar engagement with an opposing end surface of the plastic material body, the second wear interface stop surface; and each of the wear interface stop surface and the another wear interface stop surface having a hardness of a least 7 in Mohs scale of hardness.

5. The well pumping apparatus as defined in claim 11, the rod centralizer further comprising:

a mating wear interface stop surface on an end of the plastic material body for mating engagement with the corresponding wear interface stop surface on the one of the upper stop and lower stop, the mating wear interface stop surface having a hardness of at least 7 in Mohs scale of hardness.

6. The well pumping apparatus as defined in claim 5, wherein the wear interface stop surface is formed from a ceramic material.

7. The well pumping apparatus as defined in claim 6, wherein the mating wear interface stop surface is formed from a ceramic material.

8. The well pumping apparatus as defined in claim 1, wherein the wear interface stop surface is provided on a wafer.

9. The well pumping apparatus as defined in claim 8, wherein the wafer is provided with one or more anchoring members, each anchoring member being adapted for fitting within a corresponding recess in the one of the upper stop and lower stop for securing the wafer to the one of the upper stop and lower stop.

10. The well pumping apparatus as defined in claim 1, wherein each of the upper sleeve and the lower sleeve is adhesively bonded to the rod string.

11. The well pumping apparatus as defined in claim 11, wherein each of the upper sleeve and the lower sleeve is formed from metal.

12. The well pumping apparatus as defined in claim 11, wherein each of the upper sleeve and the lower sleeve has a tapered outer surface for engagement with a corresponding interior surface of the plastic material body.

13. Well pumping apparatus for powering a downhole pump to pump fluids toward the surface of well through a string well tubing, comprising:

an elongate rod string within the well tubing and interconnected with the downhole pump, the rod string being rotatable within the well tubing to power the downhole pump; and a plurality of rod centralizers spaced axially along the rod string each for centralizing the rotating rod string within the well tubing, each rod centralizer including a plastic material body having a hole therethrough for receiving the rod string, a plurality of ribs projecting radially from the plastic material body and spaced apart circumferentially to provide a plurality of flow channels for fluids passing through the well tubing in response to the downhole pump and past the rod centralizer, an upper stop and a lower stop each fixed on the rod string to limit axial movement of the plastic material body along the rod string and between the upper stop and the lower stop, an upper wear interface stop surface and a lower wear interface stop surface each affixed to a corresponding one of the upper stop and the lower stop for planar engagement with an end surface of the plastic material body, the upper wear interface stop surface and the lower wear interface stop surface each having a hardness of at least 7 in Mohs scale of hardness, and an upper sleeve and a lower sleeve each fixed to a corresponding upper wear surface and lower wear surface, respectively, and extending axially through a portion of the hole in the plastic material body, each upper sleeve and lower sleeve adapted for engagement with a respective interior upper surface and interior lower surface of the plastic material body defining a portion of the hole, and each upper sleeve and lower sleeve having a hardness of at least 7 in Mohs scale of hardness.

14. The well pumping apparatus as defined in claim 13, wherein the plastic material body has an enlarged bore spaced axially between the upper sleeve and the lower sleeve, the enlarged bore having a diameter greater than both the upper interior surface and the lower interior surface of the plastic material body for preventing the plastic material body from engaging the rod string upon wear of the plastic material body due to engagement with the upper sleeve and the lower sleeve.

15. The well pumping apparatus as defined in claim 14, wherein the enlarged bore in the plastic material body is spaced axially substantially midway along the plastic material body and between the upper sleeve and the lower sleeve.

16. The well pumping apparatus as defined in claim 13, the rod centralizer further comprising:

a mating wear interface stop surface on an end of the plastic material body for mating engagement with the corresponding one of the upper wear interface stop surface and lower wear interface stop surface, the mating wear interface stop surface having a hardness of at least 7 in Mohs scales of hardness.

17. The well pumping apparatus as defined in claim 13, wherein each of the upper and lower wear interface stop surfaces is formed from a ceramic material.

18. The well pumping apparatus as defined in claim 13, wherein each of the upper and lower wear interface stop surfaces is provided on a respective upper and lower wafer.

19. The well interface stop surface as defined in claim 13, wherein each of the upper sleeve and lower sleeve is formed from metal.

* * * * *

UNITED STATES PATENT AND TRADEMARK OFFICE

CERTIFICATE OF CORRECTION

PATENT NO. : 5,692,562

DATED : December 2, 1997

INVENTOR(S) : Squires

It is certified that error appears in the above-indentified patent and that said Letters Patent is hereby corrected as shown below:

In col. 6, line 16, change "an" to --and--.

In col. 6, line 18, change "me" to --the--.

In col. 6, line 61, change "claim 11" to --Claim 1--.

In col. 7, line 21, change "claim 11" to --Claim 1--.

In col. 7, line 24, change "cliam 11" to --Claim 1--.

In col. 7, line 30, please add --of--, after "string".

Signed and Sealed this

Seventh Day of April, 1998

Bruce Lehman

*Attest:*

BRUCE LEHMAN

*Attesting Officer*

*Commissioner of Patents and Trademarks*